US007617834B2

(12) United States Patent
Bauch

(10) Patent No.: US 7,617,834 B2
(45) Date of Patent: Nov. 17, 2009

(54) DISHWASHER

(75) Inventor: Uwe Bauch, Langenberg (DE)

(73) Assignee: Miele & Cie, KG, Gutersloh (DE)

( * ) Notice: Subject to any disclaimer, the term of this patent is extended or adjusted under 35 U.S.C. 154(b) by 645 days.

(21) Appl. No.: 11/313,511

(22) Filed: Dec. 20, 2005

(65) Prior Publication Data

US 2006/0130882 A1 Jun. 22, 2006

(30) Foreign Application Priority Data

Dec. 21, 2004 (DE) ..... 10 2004 062 767

(51) Int. Cl.
*B08B 3/02* (2006.01)

(52) U.S. Cl. ..... 134/200; 312/228.1

(58) Field of Classification Search ..... 134/200, 134/56 D

See application file for complete search history.

(56) References Cited

U.S. PATENT DOCUMENTS

| | | | | | |
|---|---|---|---|---|---|
| 1,816,213 | A | * | 7/1931 | Duke | 312/294 |
| 2,311,718 | A | * | 2/1943 | Way | 312/212 |
| 2,343,692 | A | * | 3/1944 | Miller | 312/334.13 |
| 2,668,091 | A | * | 2/1954 | Clark | 312/270.3 |
| 2,734,520 | A | * | 2/1956 | Abresch | 134/174 |
| 3,242,247 | A | * | 3/1966 | Watson | 264/219 |
| 3,519,319 | A | * | 7/1970 | Taylor | 312/246 |
| 3,529,718 | A | * | 9/1970 | Zaremski | 206/469 |
| 3,738,725 | A | * | 6/1973 | Visser | 312/246 |
| 3,954,315 | A | * | 5/1976 | Sanden | 312/333 |
| 4,984,762 | A | * | 1/1991 | Braun et al. | 248/216.1 |
| 5,306,077 | A | * | 4/1994 | Trevaskis | 312/122 |
| 6,189,551 | B1 | * | 2/2001 | Sargeant et al. | 134/200 |
| 2004/0244825 | A1 | * | 12/2004 | Ashton | 134/85 |

FOREIGN PATENT DOCUMENTS

| | | | |
|---|---|---|---|
| DE | 2919141 | | 11/1980 |
| DE | 19708805 | | 10/1997 |
| EP | 1393667 | | 3/2004 |
| JP | 2001-046301 | * | 2/2001 |
| JP | 2002-291674 | * | 10/2002 |
| JP | 2002-325714 | * | 11/2002 |
| JP | 2002-360495 | * | 12/2002 |
| JP | 2002360459 | * | 12/2002 |
| JP | 2004-261259 | * | 9/2004 |
| WO | PCT/NZ98/00008 | | 8/1998 |
| WO | WO-9833426 | | 8/1998 |

OTHER PUBLICATIONS

European Search Report mailed for European Application Serial No. 05 02 5596 on Apr. 30, 2008.

* cited by examiner

*Primary Examiner*—Frankie L Stinson
(74) *Attorney, Agent, or Firm*—Darby & Darby

(57) ABSTRACT

A dishwasher provided with a parallelepiped housing with an opening in a forward wall and a sealing gasket mounted on the lower surface of its top wall and a drawer-like washing compartment having upper margins and moveable relative to the housing along rails mounted at an inclination on the side walls in the interior of the housing between a first position outside the housing and a second position within the housing in which the upper margins engage the sealing gasket.

3 Claims, 2 Drawing Sheets

DISHWASHER

BACKGROUND OF THE INVENTION

1. Field of the Invention

The invention, in general, relates to a dishwasher and, more particularly, to a dishwasher of the kind provided with a parallelepiped housing with an opening in one of its front surfaces and a drawer-like washing compartment which is horizontally movable through the opening into and out of the housing and which has an upwardly facing opening for placing and removing dishes.

The margins of the side walls of the washing compartment extend parallel to the upper surface of the housing or an intermediate sealing surface, as the case may be, and when the compartment is in the housing, they engage it in a sealing manner.

2. The Prior Art

A dishwasher of this kind has been disclosed by WO 98/33426 A1 which gives a detailed description of the advantages of such a dishwasher.

It is, however, difficult to seal the upwardly open wash compartment sufficiently securely to prevent the escape of wash fluid. It requires a liquid-proof contact either between the top side or lid of the housing or sealing strips or ledges at the side walls of the housing extending parallel to the lid thereof and the margins of the washing compartment which define the opening thereof. As a rule, the seal is formed by flexible gaskets at both or either of the margins and the housing. The proper function of such sealing arrangement depends upon some force exerted between the sealing members. In the rear area of the dishwasher the force is established by the inward movement of the washing compartment which is directed normal to the sealing ledge. The lateral ledges, however, extend parallel to the movement of the washing compartment. Therefore, measures must be taken which provide for a vertical force between the lateral sealing edges on the compartment and housing.

In one of the structures disclosed by WO 98/33426 A1 this is accomplished by the lid of the dishwasher moving against the washing compartment at the end of the inward movement of the latter into the housing. However, such an arrangement requires linkages for translating the horizontal movement of the compartment into a vertical movement of the lid of the housing which are not only complex and, therefore, expensive, but which also are likely to suffer from a high potential of distortion.

An alternative structure of the dishwasher of WO 98/33426 A1 makes use of a washing compartment which is higher at its front section than at its rear section so that the margins of its side walls are inclined towards the rear of the dishwasher. With a correspondingly inclined lid or sealing ledge, the direction of the inward movement of the washing compartment thus extends angularly with respect to the sealing ledges and results in a wedged seal. However, the inclined disposition of the sealing margins suffers from several disadvantages. The height and, therefore, the volume of the washing compartment are reduced, And residual water on the sealing ledges runs off towards the rear of the housing.

In addition, WO 98/33426 A1 discloses structures with folding lids as well as roller-supported endless lids. These, however, their sealing leaves much to be desired. Furthermore, movable and inflatable seals are being suggested along with their complex activating structures.

OBJECT OF THE INVENTION

It is, therefore, an object of the invention to provide a simple yet effective seal for a dishwasher of the kind referred to.

Other objects and advantages will appear hereinafter.

SUMMARY OF THE INVENTION

In the accomplishment of this and other objects, the invention provides structure causing the movement of the washing compartment to be inclined relative to its upper margins or to the lid of the dishwasher, so that the upper margins are raised from a lower position into a level of engagement with corresponding sealing surfaces of the dishwasher.

The advantages of the structure in accordance with the invention reside in the simplicity of both washing compartment and dishwasher housing without impairing their volumes.

In an advantageous embodiment, the suspension of the washing compartment is made up of rails mounted on the sides of either or both of the housing and the washing compartment and the distance of which to the lid of the housing at the rear of the housing or to the rear section of the upper margin of the washing compartment is less than it is at their forward sections. Hence, it is possible to make use of telescoping rails which require no more than a mounting orientation which differs from the conventional arrangements.

In order to provide sufficient space to accommodate the washing compartment in its in forward or withdrawn position, the housing of the dishwasher is preferably provided with an empty space below the washing compartment.

In an especially advantageous embodiment of the invention there is provided an arrangement which in the operative position elevates the forward section of the housing relative to the rear section thereof, which in effect transposes movement of the washing compartment back into a horizontal orientation so that inward movement of the compartment requires only a small force while at the same time avoiding self-acting movement.

DESCRIPTION OF THE SEVERAL DRAWINGS

The novel features which are considered to be characteristic of the invention are set forth with particularity in the appended claims. The invention itself, however, in respect of its structure, construction and lay-out as well as its manufacturing techniques, together with other advantages and objects thereof, will be best understood from the following description of preferred embodiments when read in connection with the appended drawings, in which:

DETAILED DESCRIPTION OF PREFERRED EMBODIMENTS

Figure 1:
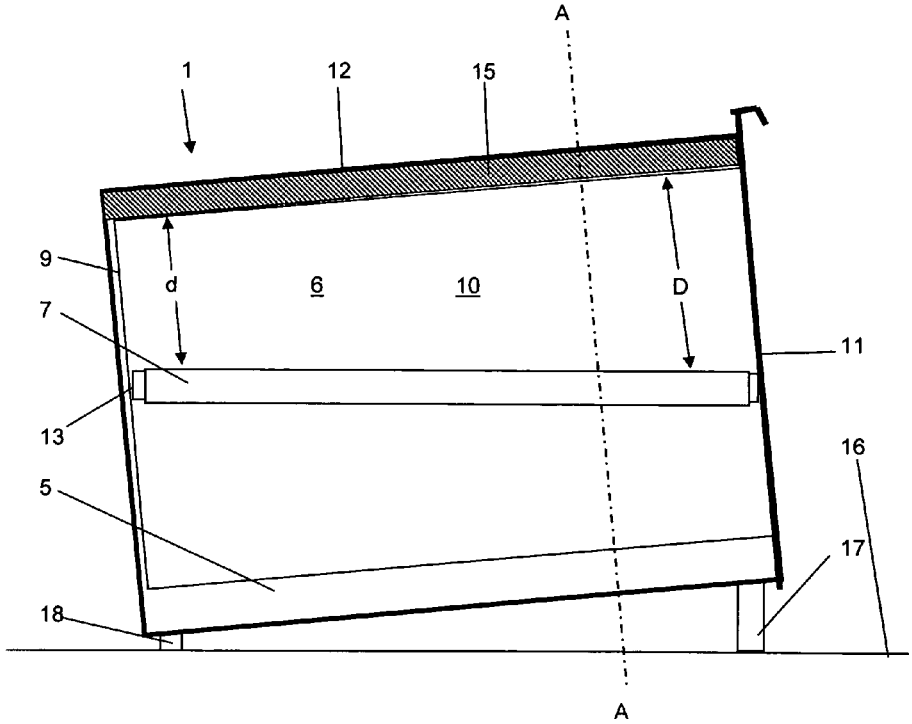
FIG. 1 is a schematic side view of a dishwasher in accordance with the invention showing the washing compartment thereof in its withdrawn position.
Figure 2:
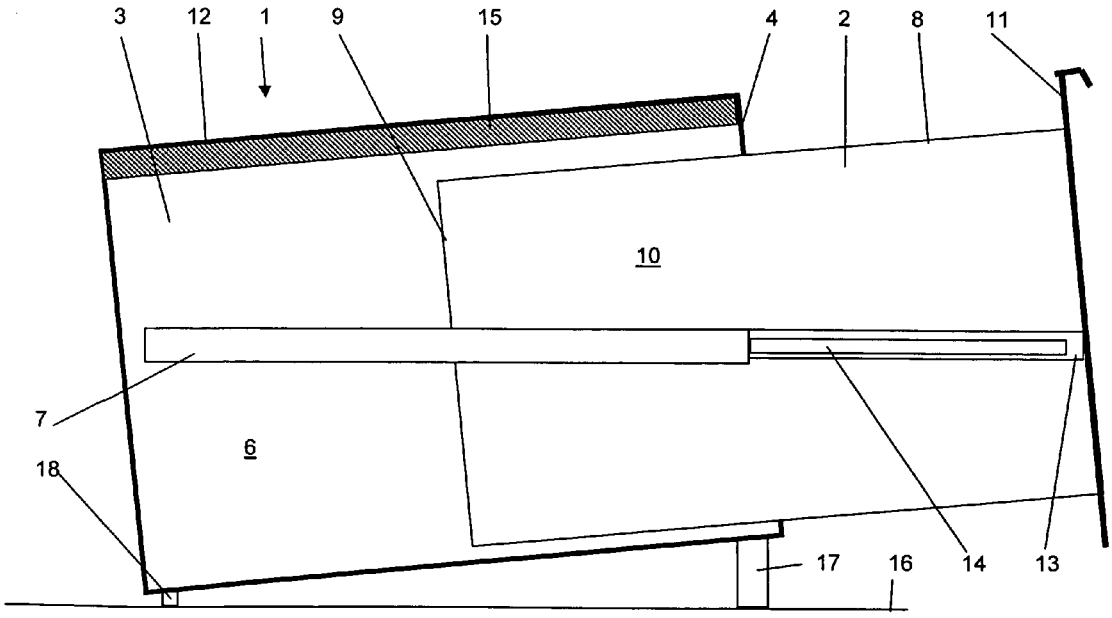
FIG. 2 is a schematic side view of the dishwasher of FIG. 1, with a side wall removed for clarity, and the washing compartment in its inserted operative position.
Figure 3:
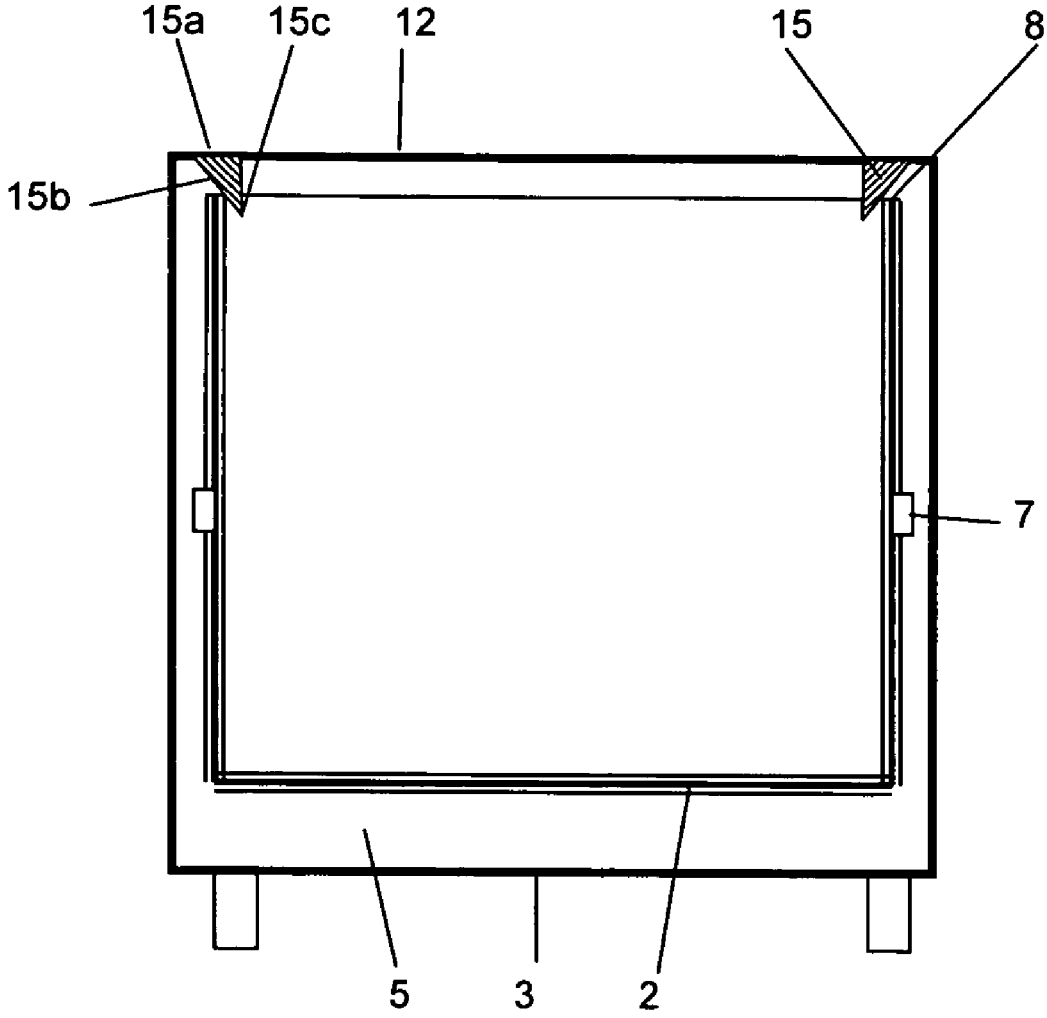
FIG. 3 is a sectional view along line A-A of FIG. 1.

The dishwasher 1 illustrated in FIGS. 1 to 3 is provided with a washing compartment 2 which for loading and unloading can be moved out of and into a housing 3 of the dishwasher 1 in the manner of a drawer and which will hereafter sometimes be referred to as a drawer. The housing 3 of the dishwasher 1 is a substantially parallelepiped structure with an opening provided in its front surface 4. Below the drawer 2, the housing 3 offers a free space 5. Preferably, the housing 3 is made of metal and in its interior an outer component 7 of a telescoping rail is mounted on each of its side walls 6.

The washing compartment 2 is also of parallelepiped shape and has an upwardly facing opening. Hence, an upper margin 8 is formed at each wall 10. While, preferably, the rear wall 9 is no higher than the side walls 10, it may, nevertheless, be somewhat higher if required. The front wall 11 is preferably somewhat higher than the side walls 10 and extends beyond the lid 12 of the housing 3, and it may be covered by a decorative plate (not shown). The basic requirement for the dishwasher in accordance with the invention is simply that the margins 8 of the side walls 10 extend parallel to the lid 12 of the housing 3. The drawer 2 is made of plastic and may, for instance, be a unitary injection or extrusion molded component. Each side wall 10 is provided with an elongate recess or channel 13 for accommodating the internal guides 14 of the telescoping rails. The guides may be fastened to the sidewalls 10 by screws, integral pins or latches, none of them having been shown in the drawings as they are thought to be well-known in the art.

In order to prevent any escape of washing fluid from the compartment 2 into the housing 3 during operation of the dishwasher at which time the compartment 2 is fully recessed into the housing 3 as shown in FIG. 2, the area of engagement of the upper margins 8 of the side walls 10 and of the rear wall 9 with the lid 12 of the housing 3 is sealed. For this purpose, a circumferential gasket 15 is mounted on the internal or lower surface of the lid 12 of the housing 3. Alternatively, the circumferential gasket 15 may be mounted on a rail (not shown) extending along the side walls 10 and rear wall 9. An other possibility (also not illustrated), would be to provide a separate gasket for each of the side walls 10 and the rear wall 9. The advantage of the gasket 15 mounted on the lower surface of the lid 12 is that it cannot be seen and that it is protected against damage by contact with other objects such as, for instance, accidentally dropped flatware and the like. Moreover, gaps required for receiving the gasket 15 are facing downwardly so that no washing fluid can accumulate in them. The circumferential gasket 15 may be a unitary molded profile. This would simplify assembly operations and ensure a proper seal in corner regions. On the other hand, a seal consisting of an individual element at each margin offers the advantage of adjustment to suit individual wall structures and configurations and that no deformation takes place in corner regions. As may be seen in FIG. 3, the cross-section of the lateral gaskets 15 corresponds to a rectangular triangle with one leg being supported by the lid 12 of the housing 3 and the hypothenuse 15*b* engaging the margin 8 of the washing container 2, thus ensuring proper sealing. Preferably, the hypothenuse faces the inward side of the margin 8 so that washing fluid dripping off the seal 15 flows into the washing compartment 2. In addition, the protruding tip 15*c* results in a labyrinth which protects the margin 8 from direct exposure to washing fluid.

The telescoping rails are mounted on the housing 3 and on the washing compartment 2 such that their distance d from the lid 12 of the housing 3 or from the upper margins of the side walls in the rear section is less than the distance D in the forward section. Thus the drawer 2 is guided at an inclination relative to the lid 12 of the housing 3 or relative to the margins 8 such that the upper margins during insertion are raised from a lower level to a raised level and into engagement with the gasket or gaskets 15 to provide the seal required for a washing operation. With the dishwasher 1 mounted normally with the lid 12 of the housing 3 being horizontally disposed, the described mounting of the telescoping rails would lead to a self-acting opening of the washing compartment 2 and require more force to close the compartment. In order to prevent this, there is provided a device which causes the forward section of the housing 3 to be elevated with respect to the rear section thereof. These may be feet 17 mounted at a forward end of the dishwasher and which are higher than feet 18 at the rear of the dishwasher. Alternatively, the dishwasher may be placed on a frame or pedestal providing a similarly inclined position.

What is claimed is:

1. A dishwasher comprising:

an inclined housing having a top wall, first and second side walls and a front wall defining an opening, a front section of the housing being raised with respect to a rear section of the housing;

a sealing device disposed on a lower surface of the top wall;

a washing compartment movable between positions outside and inside the housing, the washing compartment having opposite side walls and an end wall, each of the side walls and end wall having an upper margin;

first and second compartment rail members respectively disposed on the opposite side walls of the washing compartment; and first and second housing rail members respectively disposed on an interior side of the first and second side walls of the housing and cooperating with respective compartment rail members, the housing rail members being substantially horizontally disposed within the inclined housing with a rear end of each housing rail member being closer to the top wall than a front end of the respective housing rail member such that, as the washing compartment is moved from the outside position to the inside position along the substantially horizontally disposed housing rail members, the upper margins of the walls of the washing compartment move toward the sealing device so as to engage the sealing device and seal the washing compartment when the washing compartment is in the closed position.

2. The dishwasher as recited in claim 1, wherein the sealing device is circumferential gasket complementing a position of the upper margins of the walls of the washing compartment.

3. The dishwasher as recited in claim 1, wherein the compartment rail members and housing rail members are respective complementary telescoping rails.

* * * * *